United States Patent [19]

Wilmes et al.

[11] Patent Number: 5,027,538

[45] Date of Patent: Jul. 2, 1991

[54] LABELLING DEVICE FOR ELECTRICAL CONDUCTORS

[75] Inventors: Manfred Wilmes, Detmold; Michael Schnatwinkel, Herford; Hartmut Schmode, Blomberg; Jürgen Pampel, Bad Salzuflen; Jürgen Matthiass, Detmold; Klaus Thomalla, Bielefeld; Volker Schröder, Detmold; Friedrich Maris, Horn-Bad Meinberg; Karl-Anton Hansmann, Steinheim, all of Fed. Rep. of Germany

[73] Assignee: Weidmüller GmbH & Co., Fed. Rep. of Germany

[21] Appl. No.: 528,380

[22] Filed: May 25, 1990

[30] Foreign Application Priority Data

Jun. 1, 1989 [EP] European Pat. Off. ..... 89109899.8

[51] Int. Cl.[5] ..... G09F 3/00

[52] U.S. Cl. ..... 40/316; 24/545

[58] Field of Search ..... 40/316; 24/545, 555, 24/557

[56] References Cited

U.S. PATENT DOCUMENTS

| | | | |
|---|---|---|---|
| 4,450,605 | 5/1984 | Schäty | 24/545 |
| 4,641,443 | 2/1987 | Wilmes | 40/316 |
| 4,655,424 | 4/1987 | Oshida | 24/545 |
| 4,876,810 | 10/1989 | Diana et al. | 40/316 |

FOREIGN PATENT DOCUMENTS

| | | | |
|---|---|---|---|
| 2944748 | 5/1981 | Fed. Rep. of Germany | 24/545 |
| 2145147 | 3/1985 | United Kingdom | 24/545 |

*Primary Examiner*—Laurie K. Cranmer
*Assistant Examiner*—Cassandra L. Hope
*Attorney, Agent, or Firm*—Laubscher Presta & Laubscher

[57] ABSTRACT

A label carrier device for electrical conductors is characterized by a C-shaped rigid carrier member which, after placement on the conductor, grasps the conductor from below. The opening of the carrier member is closed with an elastic extension depending from the carrier member. The extension has a clasping member including upper and lower arms. The upper arm serves as a clamping member for clamping the conductor and also presses the lower arm toward a closed position for closing the carrier member opening.

4 Claims, 2 Drawing Sheets

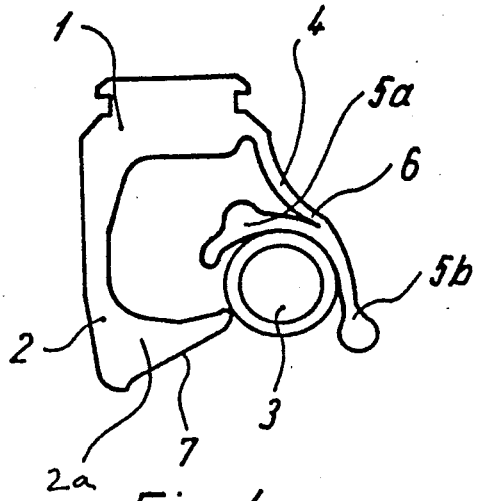
Fig. 4
Fig. 5
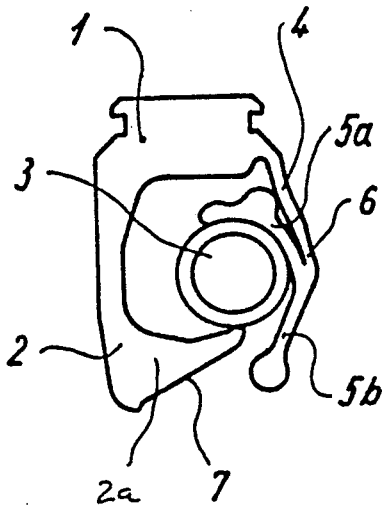
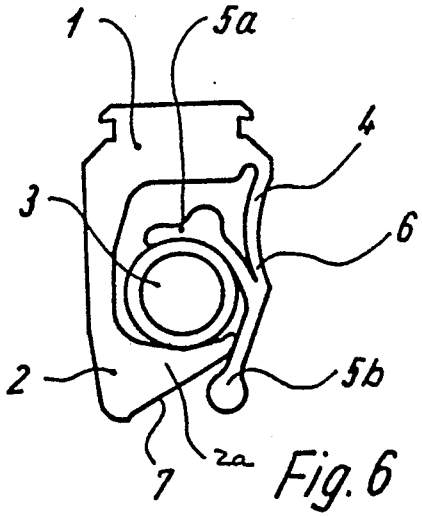
Fig. 6
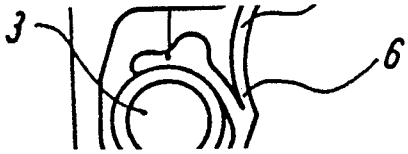

LABELLING DEVICE FOR ELECTRICAL CONDUCTORS

BACKGROUND OF THE INVENTION

The present invention relates to a label carrying device which is suitable for mounting on electrical conductors. The device includes a carrier member having two extensions, one of which extends around the conductor and the other of which includes a clamping structure for clamping the conductor against the first extension.

BRIEF DESCRIPTION OF THE PRIOR ART

Tag or label carriers for electrical conductors are known in the art as evidenced by DE-C-33 43 064. Disclosed therein is a label carrier including two elastically deformable arms which partially grasp the conductor—after the placement of the label carrier—on the underside, although they do not grasp the conductor completely. On one of the elastic arms, there is a clamping piece which lies in the path of the conductor to be received. The clamping piece is made as a latch element and, with a counter-latch, engages the carrier body in a latched manner above the conductor. The reception of the conductor and latching during the placement of the tag carrier upon an electrical conductor takes place automatically, but this manner of position fixing—with the incomplete grasping of the electrical conductor on its underside and the latching on the top side of the conductor—does not always offer adequate safety against unwanted shifting or falling-off of the label carrier. DE-C-33 43 064 also shows a label carrier with a carrier body that grasps around the conductor in a dual-arm hugging fashion, where force locking elements are provided at the lower edges of both of the elastically deformable arms, whereby several clamping elements are present which are distributed over the length of the arms.

With the prior art design discussed above, the label carrier can also be subsequently latched upon previously connected conductors through force-locking below the conductor. This can be done reliably and safely, but the latch connection requires a separate operating step since the arms must be compressed laterally. This is rather time-consuming and, in the case of normally very tight space conditions, is rather laborious. The length of the elastically deformable arms of the prior devices is also relatively great so that this label carrier has rather large space requirements.

The present invention was developed in order to overcome these and other drawbacks of the prior devices by providing a label carrying device for electrical conductors which has a simple design and which can be automatically placed and secured on a conductor that is to be labelled. The device of the present invention may be used on electrical conductors having a large diameter.

SUMMARY OF THE INVENTION

Accordingly, it is a primary object of the present invention to provide a labelling device for electrical conductors including a label carrier member having a first extension depending therefrom, the carrier member and first extension having a generally C-shaped rigid configuration to define a chamber for receiving the conductor. A clamping assembly is provided for clamping the conductor within the chamber and includes a resilient second extension depending from the carrier member opposite the chamber from the first extension and a clasping member elastically connected with the lower end of the second extension for limited rotation with respect thereto between open and closed positions. The clasping member includes an upper arm for clamping the conductor against the first extension and a lower arm biased against the first extension when the clasping member is in the closed position.

The second extension is integral with the label carrier and is resiliently connected therewith via a first hinge area. Similarly, the clasping member is integral with the second extension and connected therewith via a second hinge area.

The first extension includes an inclined guide surface for directing the conductor against the second arm of the clasping member to rotate the clasping member to the open position for insertion of the conductor, within the chamber. The second extension simultaneously flexes outwardly to receive the conductor and when the conductor is arranged within the chamber, the second extension flexes inwardly and the clasping member rotates to its closed position with the upper arm clamping the conductor against the first extension to retain the conductor within the chamber.

BRIEF DESCRIPTION OF THE FIGURES

Other objects and advantages of the invention will become apparent from a study of the following specification when viewed in the light of the accompanying drawing, in which:

FIGS. 2–6 are side plan views illustrating the operation of the label carrier as it is mounted on the conductor.

DETAILED DESCRIPTION

Figure 1:
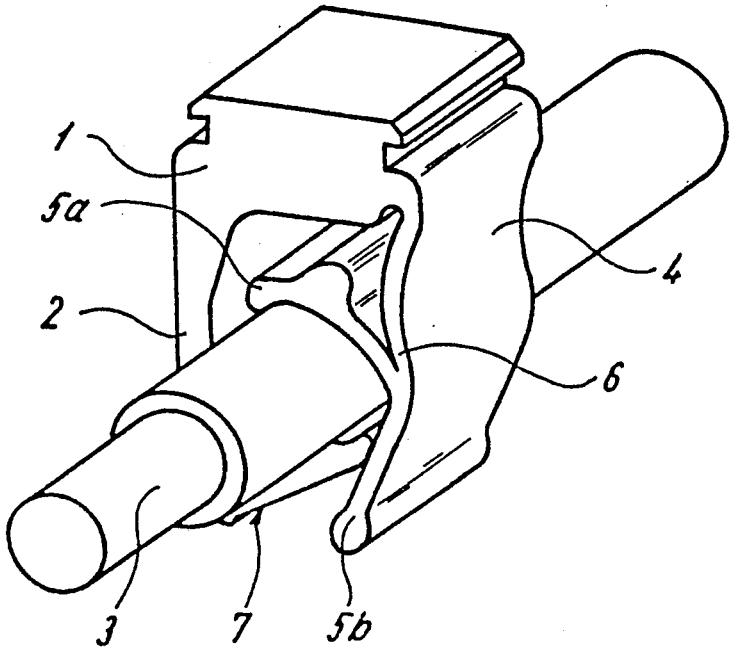
FIG. 1 is a perspective view of the label carrier according to the invention mounted upon an electrical conductor.

As shown in the drawing, the labelling device of the present invention includes a label carrier member 1 having a first extension 2 depending thereform. The carrier member and first extension have a rigid C-shaped configuration owing to the projection portion 2*a* of the extension. As shown in the drawing, the projection portion 2*a* extends generally parallel to the carrier member 1. The carrier member and first extension define a chamber for receiving an electrical conductor 3. The lower projection portion 2*a* of the extension is adapted to grasp the underside of the electrical conductor and form a rigid stable abutment for the conductor as will be developed in greater detail below.

A clamping mechanism is provided for clamping and retaining the conductor within the chamber. More particularly, a second extension 4 is provided which depends from the carrier member opposite the chamber from the first extension. The second extension thus closes the opening leading into the chamber and through which the conductor passes when the labelling device is mounted thereon.

The second extension 4 is resilient and elastically integrally connected with the carrier member 1. Thus, the carrier member and the first and second extensions define a unitary structure which is preferably formed from an electrically insulated synthetic plastic material. The elastic connection between the carrier member, and the second extension is afforded by the thickness of the synthetic plastic material at the junction between the carrier member and the second extension.

At the lower end of the second extension 4 is a clasping member 5 elastically integrally connected with the second extension by a hinge 6 for limited rotation between open and closed positions. The clasping member 5 includes an upper arm 5*a* for clamping the conductor against the first extension 2 and a lower arm 5*b* biased against the first extension projection port 2*a* when the clasping member 5 is in the closed position.

The assembly process for placing the labelling device of the invention upon an electrical conductor will be described with reference to FIGS. 2–6.

Figure 2:
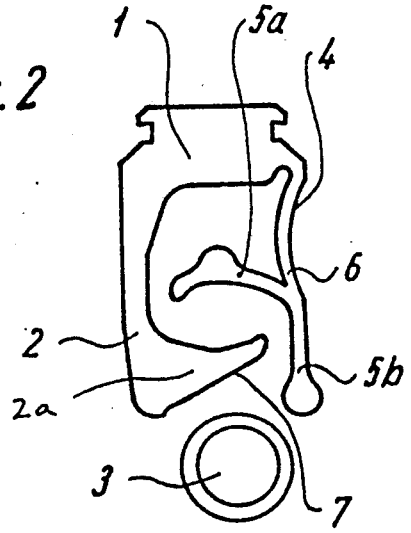
Figure 3:
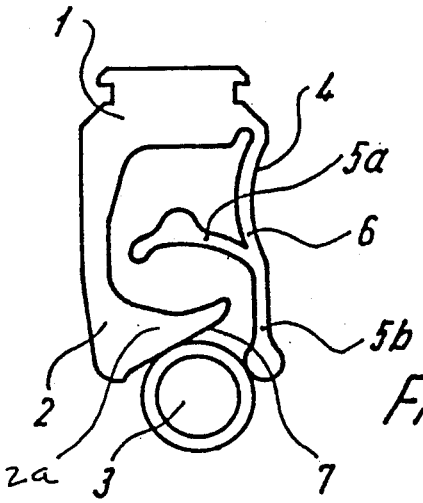

As shown in FIG. 2, the labelling device is moved in its normal rest or closed position over an electrical conductor 3 and then pressed onto the conductor from above as shown in FIG. 3. The lower surface of the first extension projection portion 2*a* comprises an inclined guide surface 7. As the device is pressed onto the conductor, the guide surface slides upon the surface of the conductor 3 until the lower arm 5*b* of the clasping member abuts against the conductor.

Further pressure from above on the labelling device causes the clasping member to rotate toward its open position. Simultaneously, the second extension flexes outwardly from the carrier member as shown in FIG. 4. When the guide surface 7 passes beyond the conductor (FIG. 5), the conductor enters into the chamber defined by the carrier member 1 and the first extension 2. When the conductor enters the chamber, it strikes the upper arm 5*a* causing the clasping member to rotate toward the closed position with the upper arm 5*a* clamping the conductor against the first extension as shown in FIG. 6. The conductor is retained within the chamber owing to the clamping force of the upper arm 5*a* of the clasping member 5. The clamping force is enhanced by the elastic restoring force of the second extension 4 which returns to its normal position.

The upper arm 5*a* of the clasping member 5 also holds the lower arm 5*b* in its closed position, pressed against the projection portion 2*a* of the first extension to preclude access to the chamber.

With the labelling device of the present invention a functionally secure hold is obtained inasmuch as the lower, internal bottom area of the C-shaped structure forms a rigid, stable abutment which completely grasps under the conductor. The pressing-on function against that abutment takes place by means of the clasping member. The unintended falling-off of the labelling device from the conductor is prevented by the pressing of the lower arm 5*b* of the clasping member first extension projection portion. A functionally reliable hold is also obtained for electrical conductors of rather considerably different diameters because the C-shape of the device facilitates dimensioning up to relatively large conductor diameters and because the clamping action of the clasping member as part of the second extension closing off the chamber as a whole takes effect with sufficient force for a large diameter conductor. During the automatic placement process up to the attainment of the closing position, the carrier device also has a very simple design with a small space requirement. Thus, it does not require any complicated force-locking elements that would bring about latched engagement.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A labelling device for electrical conductors, comprising (a) a label carrier member including a first extension depending therefrom, said member and first extension having a generally C-shaped rigid configuration to define a chamber for receiving the conductor; and (b) means for clamping the conductor within the chamber, said clamping means including (1) a resilient second extension depending from said member opposite said chamber from said first extension; and (2) a clasping member elastically connected with the lower end of said second extension for limited rotation with respect thereto between open and closed positions, said clasping member including an upper arm for clamping the conductor against said first extension and a lower arm biased against said first extension when said clasping member is in the closed position, whereby during initial insertion of the conductor into said chamber, said clasping member rotates to its open position and said second extension flexes outwardly to receive the conductor, and when the conductor is arranged within said chamber, said second extension flexes inwardly and said clasping member rotates to its closed position with said upper arm clamping the conductor against said first extension to retain the conductor within the chamber.

2. A labelling device as defined in claim 1, wherein said second extension is integral with said label carrier member and resiliently connected therewith via a first hinge area.

3. A labelling device as defined in claim 2, wherein said clasping member is integral with said second extension and connected therewith via a second hinge area.

4. A labelling device as defined in claim 3, wherein said first extension includes a guide surface for directing the conductor against said clasping member second arm to rotate said clasping member toward the open position for insertion of the conductor within said chamber.

* * * * *